United States Patent [19]

Sardella et al.

[11] Patent Number: 4,683,822

[45] Date of Patent: Aug. 4, 1987

[54] DIE MOUNTING APPARATUS

[75] Inventors: Louis M. Sardella; John B. West, both of Cockeysville; John R. Harrison, Baltimore, all of Md.; Dennis J. Parr, York, Pa.

[73] Assignee: The Ward Machinery Company, Cockeysville, Md.

[21] Appl. No.: 776,775

[22] Filed: Sep. 17, 1985

[51] Int. Cl.[4] ..... B41F 27/06

[52] U.S. Cl. ..... 101/382 MV; 101/415.1; 83/481

[58] Field of Search ..... 101/382 MV, 382 R, 375, 101/376, 378, 415.1; 269/21; 51/235; 83/481, 100, 152, 698; 279/3; 493/60, 64

[56] References Cited

U.S. PATENT DOCUMENTS

| | | | |
|---|---|---|---|
| 2,033,205 | 3/1936 | Poppe | 101/415.1 |
| 2,060,082 | 11/1936 | Johnson et al. | 101/378 |
| 2,680,994 | 6/1954 | Wood | 269/21 |
| 2,923,235 | 2/1960 | Voegelin | 101/407 |
| 3,294,392 | 12/1966 | Dunham | 51/235 X |
| 3,295,443 | 1/1967 | Devon | 101/415.1 X |
| 4,005,653 | 2/1977 | Arkell | 101/382 MV |
| 4,056,057 | 11/1977 | Smith | 101/382 MV |
| 4,089,265 | 5/1978 | White et al. | 101/382 MV X |
| 4,103,580 | 8/1978 | Sauer et al. | 83/698 X |
| 4,237,466 | 12/1980 | Scranton | 101/382 MV X |
| 4,479,435 | 10/1984 | Takeuchi et al. | 101/382 MV |
| 4,561,355 | 12/1985 | Cuir et al. | 101/378 |

FOREIGN PATENT DOCUMENTS

| | | | |
|---|---|---|---|
| 46529 | 4/1981 | Japan | 269/21 |

*Primary Examiner*—Charles A. Pearson

*Attorney, Agent, or Firm*—Boyce C. Dent; Edward D. C. Bartlett

[57] ABSTRACT

Apparatus for mounting a flexible printing plate comprises a printing cylinder having a surface upon which the printing plate is mountable, and a connection for applying subatmospheric pressure inside the cylinder. A plurality of valves selectively apply the subatmospheric pressure to the surface from inside the cylinder. These valves have depressable actuating members protrudable above the cylinder surface. Those actuating members contacted by the printing plate when applied to the cylinder surface are depressed thereby to effect application of subatmospheric pressure to beneath the printing plate to draw the plate against the cylinder. Preferably, grooves are provided in the cylinder surface for distribution of the subatmospheric pressure beneath the plate. Advantageously, the printing plate may have a thin, highly flexible and deformable fringe along its trailing edge to seal the surface grooves, at that location. This mounting arrangement facilitates quick changing of printing plates during printing operations.

20 Claims, 14 Drawing Figures

DIE MOUNTING APPARATUS

BACKGROUND OF THE INVENTION

This invention relates generally to printing and die cutting apparatus and more specifically to rotary printing and soft anvil die cutting apparatus for the corrugated paperboard industry that uses flexible printing dies on a rotating cylinder to transfer ink to the surface to be printed and serrated edge cutting rules on a rotating cylinder acting against a soft anvil roll to die cut the printed sheets. Such apparatus is generally called flexographic printer die cutters which apparatus, among other things, feeds individual sheets of corrugated paperboard past a rotating printing die to print indicia on the sheets and past a rotating die cylinder to die cut the sheets.

One problem associated with such machines has been the mounting of the printing die to the print cylinder, particularly, quick mounting of the printing die so as not to delay set-up of the machine during a change from one sheet size to another and/or a change in the indicia to be printed on the sheet. The printing dies themselves are usually made of a type of rubber or plastic mounted on a backing sheet of heavy paper, rubber, or plastic material. The backing sheet is flexible so that it can be wrapped around the print cylinder.

An early means of mounting the printing die to the cylinder was merely to staple the backing sheet to a wooden covering on the cylinder. This left much to be desired since the staples eventually ruined the wooden covering and the backing sheet making it necessary to recover the cylinder and, more often, to replace the backing sheet or the complete die. In addition, if the printing die was not placed properly on the cylinder, it had to be removed and repositioned thus resulting in additional set-up time.

Since then, various means have been employed to mount the printing die to the print cylinder. One such means required a rigid strip on each end of the die backing of which one was captured in an immovable slot in the print cylinder and the other captured in a movable slot. The movable slot included a hinged portion movable in a direction away from the immovable slot so as to tension the backing sheet. The hinge portion was moved by a pneumatically expandable tube. The die backing had to be made quite precisely and tube failures were not uncommon.

Another means uses rigid U-shaped hook strip on one end of the backing sheet that hooks in a mating U-shaped slot in the print cylinder, the so-called "Dorr" system. The other end of the sheet is made similar to a roll-up window blind with the roller placed in a slot in the print cylinder. A special tool is used to wind up the roller to tension the backing sheet to hold it tightly against the cylinder. Making the backing sheet is quite complex and expensive. In addition, relatively considerable time is required to roll up the backing sheet in the cylinder.

Probably the most popular means in current use is the so-called "Matthews" system which includes a U-shaped hook strip on one end of the backing sheet that hooks in a mating U-shaped slot in the print cylinder. A number of elastic straps are fastened to the other end of the backing sheet. Each strap has a U-shaped hook that hooks into a mating U-shaped slot in the cylinder. The elastic straps tension the backing sheet tightly against the cylinder. Making the backing sheet with straps is fairly complex and expensive and some time is required to fasten each individual strap in the slot in the cylinder.

All of the above means rely on tension to hold the backing sheet tightly against the printing cylinder. However, tension is not always necessary as evidenced by the so-called "Magna Graphics" system which uses a backing sheet of ferrous material held to the cylinder by permanent magnets embedded in the cylinder's surface. Thus, both the backing sheets and the cylinder are expensive to make. In addition, any loose ferrous materials around the press are attracted to the cylinder which can damage the ink transfer roll that transfers ink to the printing die.

One problem associated with rotary die cutters is that considerable time is required to mount the cutting die on the die cylinder. It should be recognized that a different die is needed for each order of sheets to be die cut because the sheet size and configuration varies from order to order. Sometimes several orders are run in the course of single shift thus requiring a die change prior to each order. When several minutes are required to change each die, this amounts to many minutes, and sometimes hours, of downtime each day.

Rotary die cutting is often done at the same time that the sheets are printed on the adjacent printing apparatus so that the sheets need be fed but once into the printing and die cutting apparatus. Thus, if steps are taken to reduce the amount of set-up time needed to change the printing dies, then a means of rapidly mounting die cutting dies is especially needed to reduce the total set-up time.

Die cutting dies include steel rule having serrated cutting edges permanently mounted in a curved plywood blanket that is mounted on the die cylinder. An example of such die rules and blanket is shown in U.S. Pat. No. 26,192 which shows a small hand-hole die mounted on a small plywood blanket. However, for larger die cuts to, for example, cut out a complete sheet which is more common, the die may completely cover the die cylinder from end to end and its entire circumference. In this event, the plywood blankets are made the length of the die cylinder and one-half its circumference to permit two halves to be mounted on the cylinder to form a substantially completely annular die.

The plywood blanket is substantially rigid but may warp slightly due to inherent stresses in the wood. Thus, the conventional means of mounting them is to bolt each half onto the die cylinder. The cylinder is provided with pre-tapped bolt holes and the blanket is made with bolt clearance holes in alignment with the tapped holes. Drawing down the bolts outward from the center of the blanket overcomes any warp in the die blanket so that it conforms to the curvature of the die cylinder. A great many bolts are required to hold the blanket in place which accounts for the extraordinary amount of time required to mount them.

It will be well understood by those skilled in the art that the length of the die blankets will frequently be less than the entire length of the die cylinder and often only a single blanket of one-half or less of the circumference is required to die cut a particular blank.

Accordingly, an object of the present invention generally is to provide a rapid mounting means for printing and die cutting dies.

Another object of the present invention is to provide a die mounting apparatus that is simple and inexpensively constructed that will hold printing and die cutting dies tightly against the cylinders upon which they are mounted.

A more specific object is to provide a die mounting apparatus utilizing subatmospheric pressure to hold the die against the cylinder and to do so in a manner whereby subatmospheric pressure in the cylinder is applied only to those areas beneath the die.

BRIEF SUMMARY OF THE INVENTION

The above and further objects and novel features are generally accomplished by providing a suction means associated with the cylinders to cause the dies to adhere to their respective cylinders. The suction means is arranged to direct subatmospheric pressure to only the portion of the cylinder beneath the dies.

Although the principle is the same, the arrangement for the cutting die mounting is slightly different from the printing die mounting. With respect to the printing die mounting, the print cylinder includes a plurality of laterally spaced recesses and annular grooves in its outer surface in communication with a suction means to apply subatmospheric pressure to the recesses and grooves. Thus, the backing sheet of a printing die placed on the surface of the cylinder is held in place by the subatmospheric pressure in the grooves. A pivotable valve in each recess pivots automatically upon placement of the die on the cylinder to let subatmospheric pressure from within the cylinder into only those grooves beneath the die. A laterally extending stop strip divides each annular groove into a segment extending annularly substantially around the cylinder. The recesses may be formed in the cylinder but are preferably formed as notches in the stop strip. And, auxiliary gate strips may be placed at fixed locations around the periphery of the cylinder to, upon actuation, effectively shorten the grooves to accommodate dies having a length less than the full circumference of the cylinder. The stop strip also serves to align the die when it is mounted on the cylinder. If desired, the stop strip may also include a U-shaped slot for mating engagement with U-shaped strip on the leading edge of the die to facilitate mounting.

As to the arrangement for mounting the die cutting dies, the die cylinder includes a plurality of laterally spaced recesses in the die cylinder in longitudinal alignment. Again a pivotable valve in each recess pivots automatically upon placement of the die on the cylinder. These valves are in communication with the interior of the cylinder to apply subatmospheric pressure within the cylinder to the recesses. The die blanket itself includes a plurality of laterally spaced but closed end annular grooves in its inner surface in communication with a laterally extending closed end longitudinal groove, also in the inner surface, overlying the valve recesses. Thus, subatmospheric pressure in the recesses flows in the longitudinal groove and into each annular groove connected to the longitudinal groove. Since both the longitudinal and annular grooves are closed end, they are closed to atmosphere when the blanket is placed on the cylinder. Placing the blanket on the cylinder opens only those valves beneath the blanket. Thus, subatmospheric pressure is applied only to the surface beneath the die blanket and thereby holds the die tightly to the cylinder. Since the valves are actuated by the blanket, the valves serve as a selectively operable adjustment means for restricting the subatmospheric pressure to the area beneath the die blanket.

A longitudinally extending stop may be provided if desired to aid in the alignment of the die on the die cylinder and to assure that the longitudinal groove overlies the recesses. Again, the recesses may be formed in the surface of the cylinder but are preferably formed as notches in the stop strip.

Although not essential, a few auxiliary mounting bolts may be used to retain the die on the cylinder in the event that subatmospheric pressure is lost during operation.

The principles of the invention may also be successfully applied to flat bed die cutters for holding a flat cutting die on a flat die holder.

DESCRIPTION OF THE PREFERRED EMBODIMENT

The invention as applied to mounting printing die will be described first.

Figure 1:
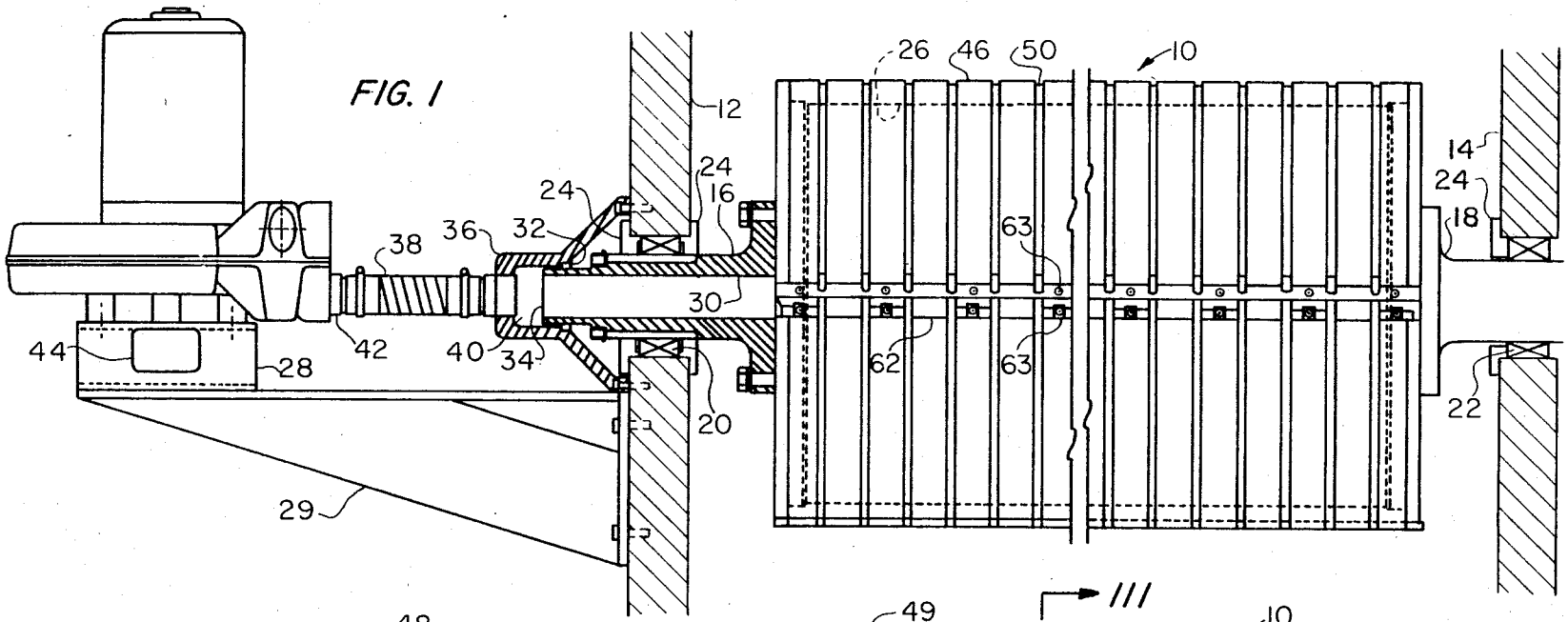
FIG. 1 is a front elevation in partial cross section showing a printing cylinder with laterally spaced annular recesses and grooves for applying subatmospheric pressure, to a printing die placed on the cylinder, from a suction means connected to the end of the cylinder.

Referring now to FIG. 1, the printing cylinder generally denoted by numeral 10 is journaled for driven rotation between a pair of stationary support members 12 and 14 by means of journals 16 and 18 supported in roller bearings 20 and 22 themselves retained in support members 12 and 14 by similar bearing retainers 24. Printing cylinder 10 is rotated in the conventional manner by a gear (not shown) secured to the end of journal 18 that is itself driven by other gears (not shown) in the gear train of the machine.

Printing cylinder 10 has a hollow interior 26 sealed to atmosphere but connected to a suction means 28 which creates subatmospheric pressure in the interior 26. Suction means 28 may be, for example, a model VFC 5O3A-7W ring compressor (blower) made by the Fuji Electric Corp. of America and available from Virginia Fluid Power, 8412 Sanford Drive, Richmond, Va. 23230. The suction means 28 is supported on a bracket 29 mounted to the support 12.

Journal 16 includes an air passage 30 in communication with the interior 26 of cylinder 10. A ring seal 32 surrounds a necked-down portion 34 of journal 16 and is encased within a seal holder 36 secured to the support means 12. A flexible hollow tube 38 connects the chamber 40 of seal holder 36 to an intake manifold 42 of the suction means 28. The seal mounting arrangement permits the cylinder 10 to rotate while providing a substantially air-tight connection between the suction means 28 and cylinder 10. Thus, upon operation of suction means 28, air is withdrawn from within the hollow interior 26 of cylinder 10 and discharged to atmosphere through an exhaust manifold 44 of suction means 28 thereby creating subatmospheric pressure within the hollow interior 26 of cylinder 10.

Still referring to FIG. 1, cylinder 10 includes an annular die mounting surface 46, for holding a printing die 48 (shown schematically by phantom lines in FIG. 3 and spaced away from the surface 46 for clarity), that extends from one end of the cylinder to the other. The suction means for holding the die 48 onto the surface 46 includes a number of laterally spaced annular grooves 50 formed in the surface 46 in communication with adjoining recesses 56 (see FIG. 5). A hole 52 in the cylinder 46 beneath each recess 56 connects each recess to the hollow interior 26 thereby directing subatmospheric pressure into each groove 50.

Since subatmospheric pressure is directed into each groove 50 it can be seen that, if there is to be no leakage of atmosphere between the die 48 and the die mounting surface 46, the die 48 must cover the entire cylinder completely around its circumference and from end to end. However, printing dies with printing areas as large as the complete die mounting surface 46 are seldom required. Although the backing sheet portion 49 of the die 48 can be as large as the mounting surface 46 with smaller printing areas thereon, such arrangement is not desirable. Instead, it is preferable to have the backing sheet only slightly larger than the printing areas of the die such as indicated schematically in FIG. 3.

Accordingly, the invention preferably includes a selectively operable adjustment means on the cylinder 10 for directing the subatmospheric pressure to only that portion of the die mounting surface 46 beneath the printing die 48 when the die is placed on the cylinder. Such adjustment means includes lateral adjustment means for controlling the width in increments along the cylinder 10 to which subatmospheric pressure is applied and annular adjustment means for controlling the circumferential length in increments around the cylinder to which subatmospheric pressure is applied.

The lateral adjustment means includes a pivotable valve 54 (as shown in detail in FIGS. 4–6) recessed in a recess 56 formed in alignment with each groove 50. The recess 56 may be formed in the cylinder 46 but is preferably formed as a notch 56 in the stop bar 62 to be described. The valve 54 is loosely pivoted about a pin 58 pressed in a groove 60 (see FIG. 4) in the bottom of the laterally extending stop bar 62 recessed in the die mounting surface 46. When a printing die 48 is not in place over the valve 54, the subatmospheric pressure in hole 52 causes valve 54 to pivot counterclockwise as viewed in FIG. 5 and thereby close the hole 52, and keep it closed, to subatmospheric pressure within the hollow interior 26. Thus, without a printing die in place, all the holes 52 are closed and no subatmospheric pressure is present in grooves 50. A conventional vacuum relief valve (not shown) is preferably connected to the intake manifold 42 so that when all the holes 52 are closed by either the valves 54 or by being covered by a die 48, atmosphere will be drawn through the relief valve and into the suction means 28 to prevent overheating of the suction means. The relief valve is pre-set to the pressure desired to hold the die 48 to the die mounting surface 46.

Figure 2:
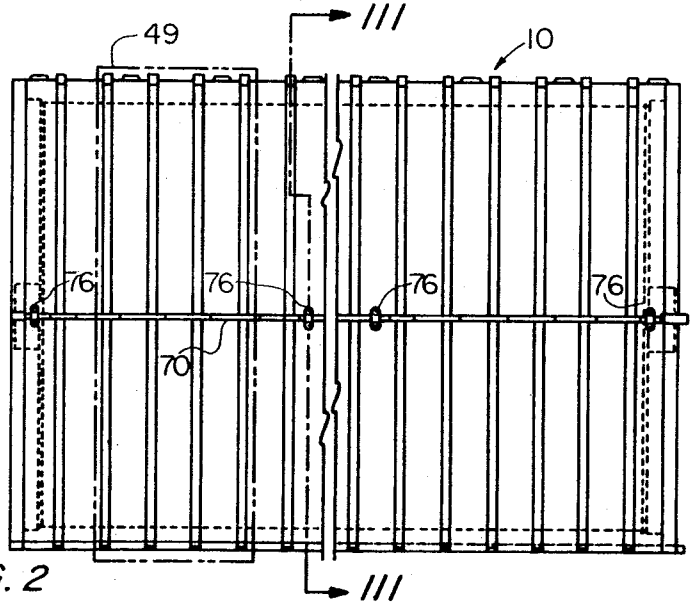
FIG. 2 is a front elevation of the die mounting surface of the printing cylinder of FIG. 1 rotated 90° from that shown in FIG. 1.
Figure 6:
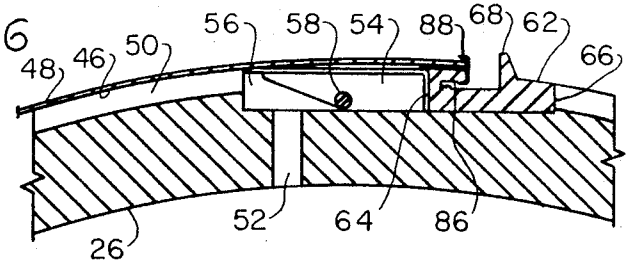
FIG. 6 is a cross sectional view similar to that of FIG. 5 showing the valve opened by mounting of the printing die to direct subatmospheric pressure into the grooves.

As shown in FIG. 6, when a printing die 48 is placed over the valves 54, the die automatically pivots the valves 54 clockwise that are beneath the die thereby opening the holes 52 to apply subatmospheric pressure to the grooves 50 that are beneath the die which holds the die firmly against the die mounting surface 46. As shown in FIG. 2, the width of the backing sheet portion 49 of the die (shown in phantom lines for clarity) is made such that its lateral edges cover the grooves 50 at the edges of the sheet. In this way, the subatmospheric pressure is limited to those grooves 50 that are beneath the die 48. The incremental width of the backing sheet 49 is determined by the printing areas of the die and the spacing between the grooves 50.

Figure 4:
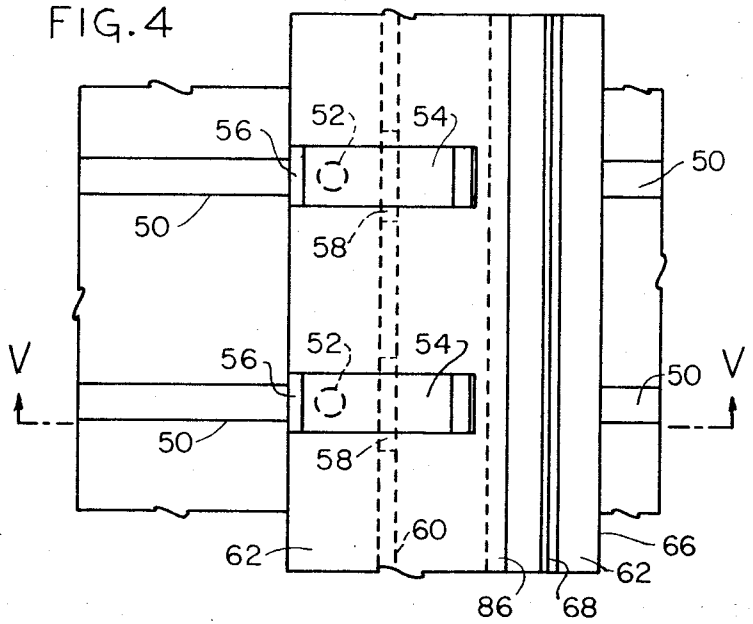
FIG. 4 is a enlarged plan view of a portion of the stop bar and valves on the printing cylinder shown in FIG. 1.
Figure 5:
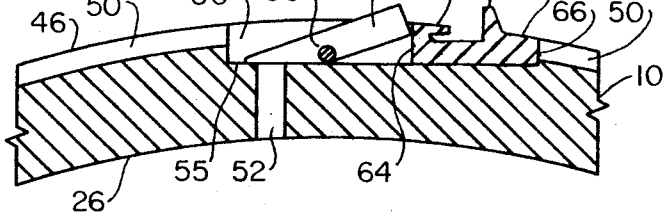
FIG. 5 is a cross sectional view of the stop bar and valves of FIG. 4 taken along the line V—V showing a valve blocking the flow of subatmospheric pressure from within the cylinder.

The annular adjustment means includes a first stop bar 62 recessed in the die mounting surface 46 and extending transverse to the direction of the grooves 50 as shown generally in FIG. 1 and in greater detail in FIGS. 4–6. It is held in place by screws 63 extending through the bar and threaded into surface 46 (see FIG. 1). Stop bar 62 serves to form a leading end 64 and a trailing end 66 in each of the grooves 50 (see FIG. 5). Although not essential, the bar 62 preferably includes an upstanding portion 68 that functions as a stop for the leading end of the die 48 when it is first placed on the die mounting surface 46. This permits the die 48 to be placed squarely on the die mounting surface 46 and also assures registration of the die in the circumferential direction a will be readily understood by those skilled in the art.

Figure 3:
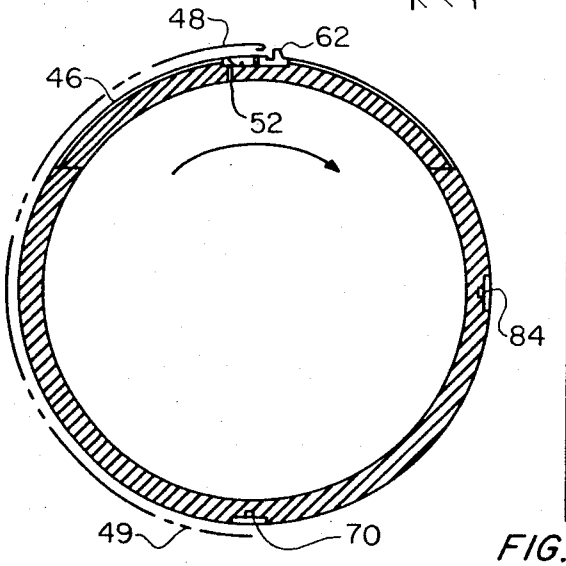
FIG. 3 is a cross sectional view of the cylinder of FIG. 2 taken along the line III—111.

A second gate bar 70 is placed at 180° from the first stop bar 62 to conform to industry practice as to circumferential location (see FIG. 3).

Figure 7:
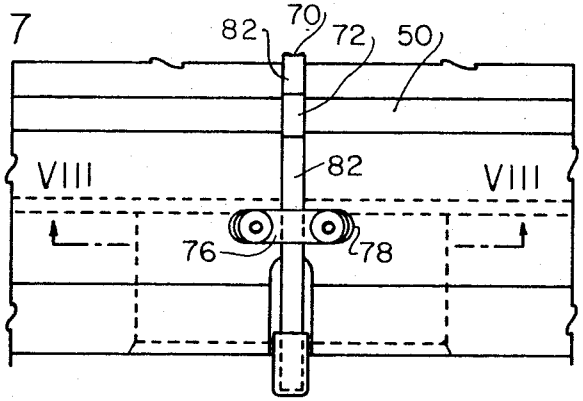
FIG. 7 is an enlarged plan view of a portion of the auxiliary gate bar on the printing cylinder shown in FIG. 2.
Figure 8:
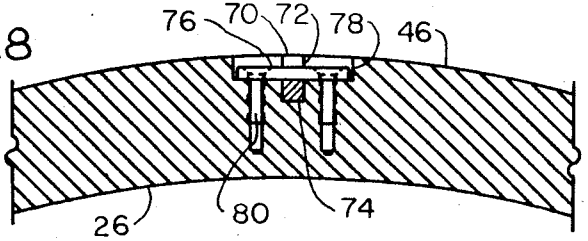
FIG. 8 is a cross sectional view of the auxiliary gate bar of FIG. 7 taken along the line VIII—VIII showing the mounting of the auxiliary gate bar.

As shown in FIG. 2, 7 and 8, the second bar 70 also extends transverse to the direction of grooves 50. Bar 70 serves to form another trailing end stop 72 in the grooves 50 so that a shorter die 48 may be used when the printing surface of the die does not extend completely around the cylinder 10.

The second bar 70 is recessed in a groove 74 in the die mounting surface 46 as best shown in FIGS. 7 and 8. It is held in place by several retaining plates 76 spaced across the width of the surface 46 (see also FIG. 2). The retaining plates 76 are recessed in slots 78 and held in place by screw 80 threaded into the die mounting surface 46. The top of the bar 70 is flush with the die mounting surface 46 except for notches 82 between the grooves 50 as best shown in FIG. 7. The notches 82 also pass beneath the retaining plates 76 which are secured in the recesses 78 so a to hold the bar 70 snugly in groove 74 but still permit it to slide laterally in the groove 74. Thus, in the position shown in FIG. 7, the bar 70 blocks the grooves 50 and forms the trailing end stop 72. In this way, the subatmospheric pressure extends in grooves 50 from the leading end stop 64 at the first bar 62 to the trailing end stop 72 and, in conjunction with the valves 54, limits the application of the subatmospheric pressure in grooves 50 to only the area beneath the backing sheet. Thus, the backing sheet need only extend from just over the first bar 62 to just over the second bar 70 as shown schematically in FIG. 3.

However, when it is desired to use a full wrap die (substantially 360° circumferential length), the bar 70 is merely pushed laterally (upward as viewed in FIG. 7) by hand until the notches 82 in bar 70 are aligned with grooves 50 in the die mounting surface 46. This permits the subatmospheric pressure to continue in grooves 50 to the trailing end stop 66 thereby accommodating a full wrap die. In this manner, there is provided a selectively operable adjustment means to direct the subatmospheric pressure to only that portion of the printing die mounting surface that is beneath the die 48.

Again, to conform to industry practice, another bar 84 is provided at about 270° from the first stop bar 62 in the counterclockwise direction as viewed in FIG. 3. Bar 84 is in all respects like bar 70, including its installation in die mounting surface 46; thus, no further description is required. Bar 84 permits the use of a printing die whose circumferential length is approximately three-fourths of the circumference of cylinder 10.

Although not essential, the first stop bar 62 may include a U-shaped slot 86, as best shown in FIGS. 5 and 6, to accommodate a mating U-shaped strip 88 on the leading edge of the backing sheet. The strip 88 may be of the type used with the Matthews system previously described. It is stapled and/or glued to the backing sheet and, when inserted in the slot 86, provides a firm anchor for the leading edge of the backing sheet. This is helpful, especially when full wrap dies are used, because of limited accessibility to the print cylinder in letter presses. Thus, the die 48 may be hooked to the first stop bar and the cylinder 10 rotated slowly by electrical means, as will be readily understood by those skilled in the art, so that the operator can hold the trailing end or sides of the die during such rotation and guide it into place on the die mounting surface 46.

The size of grooves 50, their lateral spacing, and the magnitude of the subatmospheric pressure are not critical. It has been found, with a nominal 66 inch circumference print cylinder 10, that grooves 50 laterally spaced about 2 inches on center with the subatmospheric pressure at about 27–30 inches of water, the die 48 is held firmly on the cylinder at rotations up to 170 R.P.M. with the width of the grooves about 0.312 inches and their depth about 0.187 inches. However, the depth of the grooves may be very shallow, on the order of 0.015–0.020 thousandths of an inch deep. There seems to be no point in making them deeper than 0.187 inches since distribution of the subatmospheric pressure is not enhanced by greater depth. If the grooves are wider than about 0.312 inches, the backing sheet may belly into the groove, depending on the stiffness of the backing sheet, which is detrimental to the printing operation.

Figure 13:
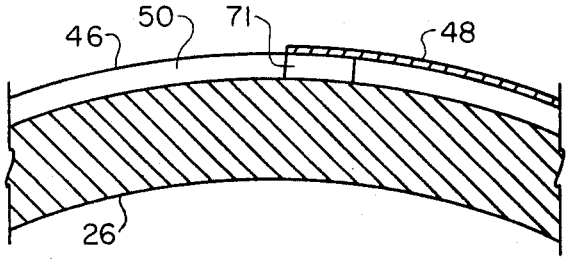
FIG. 13 is an enlarged sectional view similar to FIG. 8 showing the use of a groove damper to prevent escape of subatmospheris pressure from the grooves at the trailing end of a printing die.

If desired, rather than providing the gate bars 70 and 84, short strips of material 71 may be secured to the trailing end of each printing die 48 that serve as a groove damper to prevent the escape of subatmospheric pressure from the grooves at the trailing end of the die. This arrangement is shown in FIG. 13.

Figure 14:
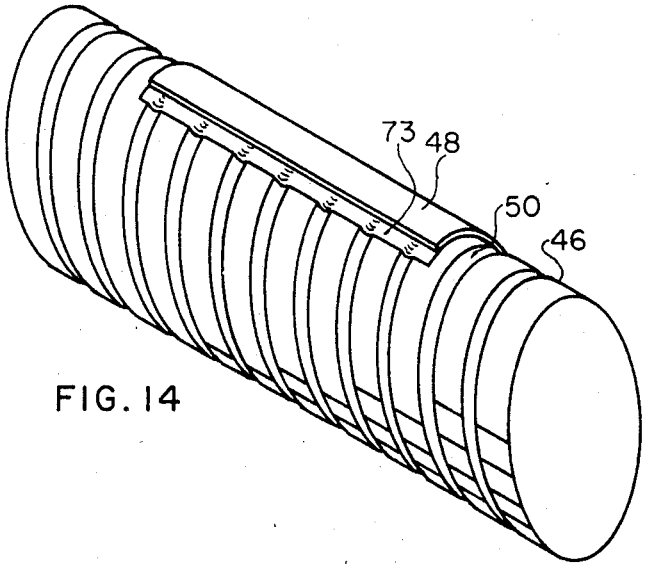
FIG. 14 is an isometric illustration showing the use of a flexible groove damper to prevent the escape of subatmospheric pressure from the grooves at the trailing end of the printing die.

Still another type of groove damper may be employed to seal the grooves at the trailing end of the die 48. This involves securing a piece of thin, flexible plastic material 73 to the end of the die that will deform, under the influence of the subatmospheris pressure in grooves 50, into the grooves 50 along the trailing edge of the die 48. This arrangement is illustrated in FIG. 14. When this method is used, the grooves 50 are preferably rounded as shown to enable the plastic piece 73 to conform to the shape of the groove. The flexible material 73 may take the form of a thin (e.g. 0.020 inches) strip of flexible magnetic material, such as sold commercially by the 3M Company, that will adhere to the ferrous surface 46.

As previously mentioned, the invention is applied a little differently for mounting a die cutting die to the cutting die cylinder. As well understood by those skilled in the art, the cutting rules are mounted to a rigid curved plywood die board (die blanket) which is mounted to the die cylinder. The die blanket includes narrow grooves in which the rules are placed in the configuration of the size and shape that the sheet of paperboard is to be cut. The rules extend completely through the thickness of the die blanket so that their bottom edges are supported on the underlying steel die cylinder. Such support is desirable since considerable force is exerted on the rules as they penetrate through the sheet and into an adjacent anvil cylinder covered with a so-called "soft" cover of urethane or similar material. The rules may be formed into many different shapes such that some of the rules would cross any grooves in the cylinder while others might extend annularly and possibly lie directly over a groove. In this event, there would be no support for the rule.

Accordingly, instead of having the annular vacuum grooves in the cylinder, they are formed in the plywood die blanket. Thus, they may be placed in each individual blanket in a position such that a cutting rule will not extend through them.

Figure 11:
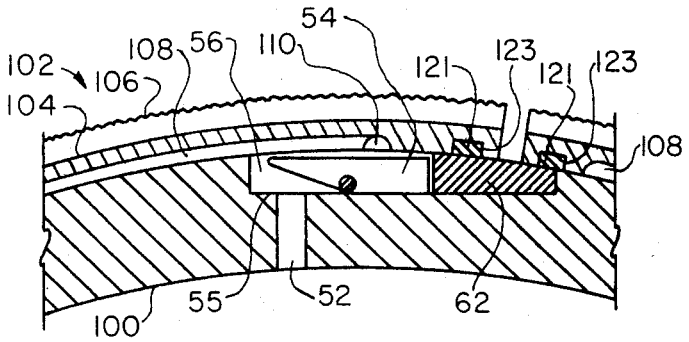
FIG. 11 is an enlarged sectional view similar to FIG. 6 showing the arrangement of the invention for the die cutting cylinder.
Figure 12:
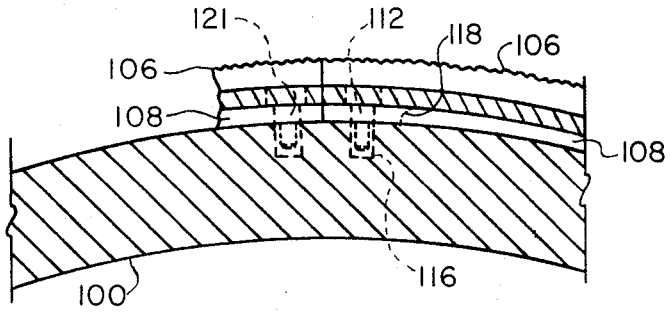
FIG. 12 is an enlarged sectional view similar to FIG. 11 showing the trailing end of the cutting die on the cylinder butting against the other half of the die.

This is best illustrated in FIGS. 11 and 12 which show a portion of a die cylinder 100 upon which a cutting die generally denoted by numeral 102 is mounted. The die 102 includes a wooden die blanket 104 in which cutting rules 106 are secured in the conventional manner.

In most respects, the suction means is the same as that shown in FIGS. 4–6 and are denoted by the same object numbers with whatever differences there are to be explained. Thus, the cylinder 100 includes a longitudinally extending recess 55 in which the notched bar 62 is secured. The upstanding portion 68 may be omitted, if desired, as shown in FIG. 11. Pivotable valves 54 are retained by pins 58 and operate as previously described to let subatmospheric pressure into the recesses 56 through the holes 52. Preferably, the bar 62 is notched, as previously described, to form recesses 56 although it does not include a hook portion 86 such as described for the printing die.

However, instead of grooves 50 (FIG. 5) being formed in the cylinder 100, annular grooves 108 are formed in the die blanket 104 as shown in FIG. 11.

Since these grooves must be spaced laterally to miss the cutting rules 106, which themselves may be in longitudinal alignment with the recesses 56, a longitudinally extending groove 110 is formed in blanket 104. Groove 110 extends across the recesses 56 that are beneath the blanket 104 but terminate short of the edges of the blanket so that the groove 110 is not vented to atmosphere; similarly, the grooves 108 terminate short of the leading and trailing edges of the blanket for the same purpose. The longitudinal or lateral groove 110 serves to connect all the annular grooves 108 so that subatmospheric pressure is confined to only the area beneath the blanket 104. Groove 110 need not be a continuous groove so long as its longitudinal segments overlie a recess 56, it being understood that various segments may have to be shifted circumferentially to miss a longitudinally extending cutting rule. The only requirement is that it connect all the grooves 108 that themselves do not overlie a recess 56.

Since the die 102 is substantially rigid and quite heavy in relation to the weight of a printing die, it could be damaged by loss of subatmospheric pressure during operation. Accordingly, a holddown bolt 112 may be used in each corner of the die to retain the die on the cylinder in the event of a loss of vacuum. The bolts 112 may be threaded in the cylinder 100 as shown in FIG. 12. A series of threaded holes 116 may be spaced across the cylinder 100 to accommodate dies of different widths.

FIG. 11 shows a full wrap die 102; that is, one that extends substantially completely around the cylinder 100. However, since the die is rigid, it must be made in two halves to permit its being mounted on the cylinder. FIG. 12 shows where the two halves meet half way around the cylinder with the corners bolted directly into threaded holes 116 in the cylinder 100.

It should be understood that if the die 102 is only a half-wrap die (that is, it only extends half way around the cylinder 100), then the groove 108 will terminate short of the trailing edge of the die 102 as denoted by the dotted line 118. Otherwise, the groove 108 continues uninterrupted in both halves of the die as shown.

Since the die blanket 104 is conventionally made of substantially rigid curved plywood, it may not fit perfectly against the surface of the cylinder 100 when first placed upon it. Thus, subatmospheric pressure in the grooves 108 may leak past the edges of the blanket 104 when first applied so that the blanket will not be drawn tightly against the cylinder. It is therefore desirable to place a seal 121 in a groove 123 formed around the periphery of the blanket 104 as shown in FIG. 11. The seal may be in the form of a ribbon of deformable rubber o plastic material that completely fills the peripheral length of groove 123. In its free state, the cylinder contacting face of the seal should extend beyond the bottom surface of the blanket from about 0.032 to 0.250 inches, preferably about 0.125 inches. Thus, when the blanket 104 is first placed on the cylinder, the first contact will be made by the seal. Then, when subatmospheric pressure is applied, it will not leak beyond the edges of the blanket which will be drawn into tight contact with the surface of cylinder 100. In doing so, the seal 121 will be deformed into groove 123 and coplanar with the underside of the blanket as shown in FIG. 11.

In the event there should be any leakage through the grooves in which the cutting rules 106 are seated, the underside of the blanket 104 may be covered with a sealing material such as a coat of urethane paint.

Figure 9:
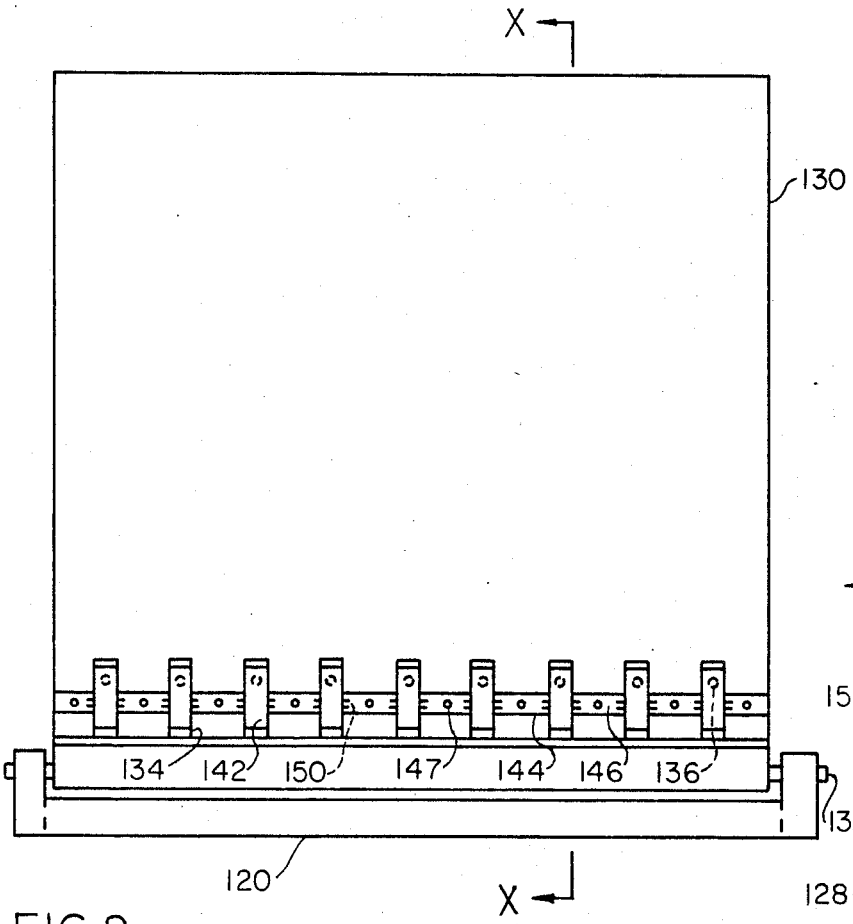
FIG. 9 is a side view schematically illustrating the die holder of a flat bed die cutter modified for holding a cutting die by subatmospheric pressure according to the present invention.
Figure 10:
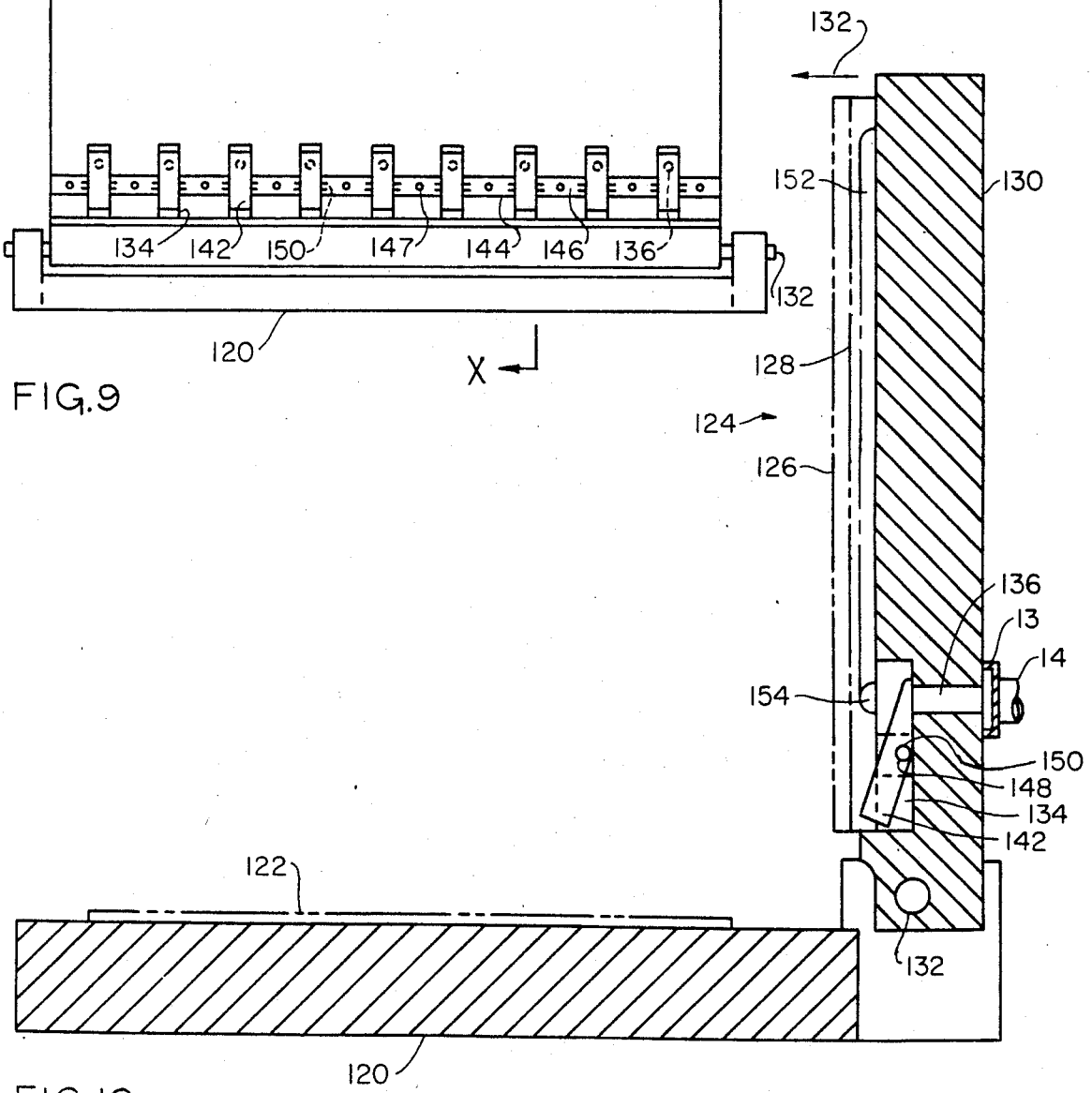
FIG. 10 is an enlarged sectional view of the die holder of FIG. 9 taken along the line X—X.

The principles of the invention may also be applied to flat bed or platen type die cutters such as schematically illustrated in FIGS. 9 and 10. Such die cutters include a platen 120 upon which a blank 122 to be die cut is placed either manually or automatically. It also has a cutting die generally denoted by numeral 124 consisting of a number of cutting and creasing rules 126 mounted to a die board 128 in much the same manner as the rules previously described for a rotary die cutter. The main difference is that the rules usually have straight rather than serrated cutting edges which penetrate through the blank 122 and against the steel platen 120.

The die board 128 is mounted to a support frame 130 which is arranged to pivot about a hinge 132 to bring the die 124 against the platen 120 as denoted by arrow 132 in FIG. 10. When the support frame 130 is pivoted, the cutting rules 126 die cut the blank 122 which is then removed from the machine after the frame 130 is returned to its upright position.

The invention is applied to the platen type die cutter of FIGS. 9 and 10 by modifying the support 13O in much the same manner as the die drum 100 of FIG. 11. More specifically, recesses 134 are formed in the support 130 and spaced across its width as shown in FIG. 9 (the die 124 has been omitted from FIG. 9 for clarity). A hole 136 extends from the bottom of each recess to the back of the support 130. A conduit 138 covers all of the holes 136 on the back of support 130 as shown in FIG. 10. Flexible hose 140 connected to conduit 138 supplies subatmospheric pressure to all the holes 136. The suction keeps the pivotable valves 142 in the position shown in FIG. 10 except for those that are beneath a die board 128 placed on the support 130 in which event the pivotable valves 142 will pivot to a flat position beneath the die board such as shown in FIG. 11. The flexible hose 140 permits the continuous application of suction to the recesses 134 as the frame 130 pivots towards the platen 120.

A groove 144 connects all the recesses 134. A block 146 is secured in the groove 144 between each of the recesses 134 by screws 147. Each block itself includes a round groove 148 for pivotally supporting a pin 150 that passes through each pivotable valve 142. This arrangement retains the valves 142 in the recesses 134 while permitting them to pivot therein.

The die 124 is made very similar to the curved die 102 shown in FIG. 11. A number of grooves 152 are formed in the back of the die board 128 as shown in FIG. 10. They are connected by a lateral groove 154 that passes across the recesses 134. Thus, suction in the recesses 134 covered by a die board 128 passes to each of the grooves 152 via the lateral groove 154 to hold the die 124 tightly against the support 130. Since the groove 154 and grooves 152 terminate short of the edges of the die board 128, the suction is confined to the area beneath the die board 128. If desired, a peripheral seal may be incorporated in the die board (not shown) such as was described in connection with the blanket 104. A few bolts (not shown) may be used to secure the die board 128 to the support 130 in the event that suction is lost during operation such a described in connection with FIGS. 11 and 12.

OPERATION

With respect to operation of the printing die mounting apparatus, the compressor 28 is turned on to apply subatmospheric pressure to the interior 26 of cylinder 10. A die 48 is selected for use; it can be a full-wrap die extending from U-shaped hook 86 to the upstanding portion 68 of bar 62 (counterclockwise as viewed in FIG. 3) or a shorter one extending to bar 84 or still shorter, extending to bar 70 as previously explained. If a full-wrap die is used, the bars 70 and 84 are pushed up (as viewed in FIG. 7) to place the notches 82 in alignment with the grooves 50 so that subatmospheric pressure can flow from the recesses 56 to the ends of the grooves 50 abutting the stop bar 62. If a three-quarter wrap die is used, bar 84 is positioned to close off the grooves 50 and if a one-half wrap die is used the bar 70 is positioned to close off the grooves 50. The U-shaped strip 88 on die 48 is hooked on the mating U-shaped slot 86. In so doing, the valves 54 beneath the die 48 are caused to pivot clockwise by the pressure of the die thereby opening ports 52 which permits the subatmospheric pressure to be applied to the grooves 50 beneath the die.

The die is guided around the cylinder 10 and held in place on the die mounting surface 46 by the subatmospheric pressure in the portions of the grooves 50 beneath the die 48. The printing section of the machine may then be operated in the normal manner.

If no bars 70 or 84 are used to achieve annular adjustment of the subatmospheric pressure in grooves 50, then the printing die 48 may be fitted with groove dampers 71 or 73 to prevent the escape of subatmospheric pressure from the grooves 50 at the trailing end of the die.

If a die 48 is used that does not include a U-shaped strip 88 on the die, the leading edge of the die is merely placed against the upstanding portion 68 of bar 62 to align the die on the cylinder. Doing so will also pivot the valves 54 in the same manner as described above so that installation of the die remains essentially the same.

When the printing run is completed, the compressor 28 is turned off which stops the application of subatmospheric pressure and automatically releases the die from the mounting surface 46. The die 48 is then merely unhooked from the U-shaped slot 86 and the cylinder 10 is ready for the next set-up.

The operation of the rotary die cutting die mounting apparatus is similar to that described in connection with the printing die. Either a full wrap of half wrap die may be used. There are no adjusting bars (similar to bar 70, FIG. 7) to be used. After the cutting die is mounted to the die drum 100 and held in place by the subatmospheric pressure, the bolts 112 may be used to secure the die to the drum should the supply of subatmospheric pressure fail; if desired, the die may first be secured by the bolts 112 and then the suction applied to hold the undersurface of the die in tight engagement with the drum.

Likewise, the flat die 124 of FIG. 10 may be initially secured to the support 130 by a few bolts and then the suction pressure applied to pull the die flatly against the support. The die board 124 activates only those valves 142 that are beneath the die board so that the suction is limited to only those areas beneath the die.

If desired, a conventional vacuum pressure switch (not shown) may be connected, for example, to the chamber 40 to detect the loss of subatmospheric pressure which would release the die 48 during operation. The switch can be connected to a stop circuit of the machine to stop it if subatmospheric pressure is lost. It has been found that it takes about 12 seconds for the subatmospheric pressure to bleed down enough to release the die whereas the machine will usually stop in about 6 seconds, giving a factor of 100% for stopping the machine prior to the die being released. Since the die 48 is relatively light and flexible, no damage is likely to occur should it be released in this manner.

Although a pivotable valve 54 has been described as preferred for containing the subatmospheric pressure within the die cylinders, other types of valves made for achieving this function may no doubt be successfully adapted for this purpose and are embraced by the principles of this invention.

Dies previously made for the prior art mounting arrangements previously discussed may in most cases be easily modified for use with this invention by removing any leading and trailing end fastening means. Any resulting die must, of course, be long enough to extend from the upstanding stop portion 68 to one of the bars 70 or 84 or all the way around to the bar 62 unless one of the groove dampers 71 and 73 is used. If desired, a U-shaped hook strip, if not already present, can be mounted to the leading edge of the die and used as described above.

Accordingly, the invention provides a simple, less expensive means for mounting printing and die cutting dies that requires much less time for mounting than is required by prior art apparatus.

Thus, having described the invention in its best embodiment and mode of operation, that which is desired to be claimed by Letters Patent is:

1. Die mounting apparatus, comprising:

a die mounting surface for holding a die;

suction means in said surface for applying subatmospheric pressure to the bottom surface of a die on said surface to hold said die firmly against said surface;

said suction means including a plurality of laterally spaced recesses in said surface from which said subatmospheric pressure is applied to said bottom surface of said die;

said recesses each including a valve means therein, each of said valve means being operable to direct said subatmospheric pressure to said bottom surface, upon placement of said die upon said die mounting surface and over said valve means, to direct said subatmospheric pressure from only those recesses covered by said die;

said die mounting surface comprising an annular rotatable cylinder;

said suction means including a plurality of laterally spaced annular grooves in said die mounting surface each of which is in communication with one of said laterally spaced recesses for directing said subatmospheric pressure in said recesses to said bottom surface of said die;

said die mounting surface including a first stop means, extending transverse to the direction of said annular grooves and across an end of each of said recesses, for closing such ends to the flow of said subatmospheric pressure;

said die mounting surface including a second stop means, extending transverse to the direction of said grooves and across said grooves at a location spaced from said first stop means, for closing said grooves to said subatmospheric pressure so that, together with said valve means covered by said die, said subatmospheric pressure is applied only beneath said die; and said second stop means being selectively operable to direct subatmospheric pressure along portions of said grooves extending beyond said second stop means.

2. The appparatus of claim 1 wherein:

said first stop means includes a lip portion for receiving a mating lip portion of said die.

3. The apparatus of claim 1, wherein said second stop means comprises a bar slidably mounted in a transverse groove in said die mounting surface, said bar having a plurality of openings therethrough, said openings registering with said annular grooves when said bar is selectively slid to one transverse position and said bar blocking said grooves when slid to another transverse position.

4. Die mounting apparatus, comprising:

a die mounting surface for holding a die;

suction means in said die mounting surface for applying subatmospheric pressure to the bottom surface of a die on said die mounting surface to hold said die firmly against said die mounting surface;

said suction means including a plurality of laterally spaced recesses in said die mounting surface from which said subatmospheric pressure is applied to said bottom surface of said die;

said recesses each including a valve means therein, each of said valve means being operable to direct said subatmospheric pressure to said bottom surface, upon placement of said die upon said die mounting surface and over said valve means, to direct said subatmospheric pressure from only those recesses covered by said die;

said die mounting surface comprising an annular rotatable cylinder;

said suction means including a plurality of laterally spaced annular grooves in said die mounting surface each of which is in communication with one of said laterally spaced recesses for directing said subatmospheric pressure in said recesses to said bottom surface of said die;

said die mounting surface including a first stop means extending transverse to the direction of said annular grooves and across an end of each of said recesses for closing such ends to the flow of said subatmospheric pressure;

said annular grooves being adapted to receive a groove damper on said die for closing said grooves to said subatmospheric pressure for limiting the application of said pressure to only the area of said die mounting surface beneath said die; and said groove damper comprising a strip of flexible plastic material secured to a trailing end of said die and adapted to seat against said die mounting surface and in said grooves in response to the application of said subatmospheric pressure in said grooves.

5. Die mounting apparatus, comprising:

a cylinder having a die mounting surface and being mounted for rotation about a central axis;

means for applying subatmospheric pressure to an interior of said cylinder;

a plurality of recesses in said surface and spaced apart across said surface along a direction parallel to said axis;

a plurality of passageways in said cylinder for providing communication between said interior and said recesses;

an elongate valve member pivoted intermediate opposite ends thereof in each of said recesses, each valve member being pivotal between open and closed positions;

in said closed position, one end of the valve member closing a respective one of said passageways and the other end of the valve member protruding out of the respective recess proud of said die mounting surface;

in said open position, said other end of the valve member being accommodated below said die mounting surface in the respective recess and said one end of the valve member also being accommodated below said die mounting surface in said respective recess but spaced from said respective one of said passageways to open this passageway and place said respective recess in communication with said cylinder interior;

a die mounted on said die mounting surface and extending over at least some of said recesses;

a plurality of grooves defined between said die and said die mounting surface, said grooves communicating with said at least some of said recesses; and said die causing the respective valve members in said at least some of said recesses to pivot to said open position by contact with said other end of each of said respective valve members.

6. The die mounting apparatus of claim 5, further comprising a bar disposed in said die mounting surface and extending along said direction, said recesses being located in said bar.

7. The die mounting apparatus of claim 6, wherein each said valve member pivots on a pivot pin mounted in said bar.

8. The die mounting apparatus of claim 7, wherein said die is a printing die, said grooves are disposed in said die mounting surface, and said bar extends across said grooves and blocks said grooves adjacent one side of said recesses.

9. The die mounting apparatus of claim 5, wherein:

said die comprises a cutting die board carrying at least one cutting rule;

said grooves are disposed in said cutting die board;

said cutting rule extends completely through said cutting die board and is supported by and on said die mounting surface; and said grooves are spaced to miss said cutting rule so that said cutting rule does not extend through said grooves.

10. Rotary cutting die apparatus, comprising:

a cutting die cylinder having a die mounting surface and being mounted between spaced apart supports for rotation about a central axis;

means for connecting an interior of said cylinder to a source of subatmospheric pressure;

a plurality of valves carried by said cylinder and spaced apart across said cylinder along a direction parallel to said axis, said valves controlling application of said subatmospheric pressure from said cylinder interior to said die mounting surface;

each valve having an actuating member which protrudes above said die mounting surface when the respective valve is closed, depression of said actuating member opening the respective valve for applying said subatmospheric pressure to said die mounting surface;

a cutting die mounted on said die mounting surface, said die being held on said surface by the subatmospheric pressure applied thereto through those of said valves which underlie said die and are opened by depression of their actuating members by said die;

said die comprising a cutting die board carrying at least one cutting rule, said cutting rule extending through said board and being supported by and on said die mounting surface;

grooves formed in an underside of said board and communicating with the opened valves for distribution of said subatmospheric pressure between said die mounting surface and said board, said grooves terminating short of a periphery of said board;

a seal disposed between said board and said die mounting surface, said seal extending around said periphery;

said periphery having corners; and bolts extending through said board at said corners and fastened into said cylinder to hold said die in place on said cylinder in the event of a loss of the subatmospheric pressure at said die mounting surface.

11. The rotary cutting die apparatus of claim 10, wherein:

said grooves comprise annular grooves connected by a transverse groove extending parallel to said axis; and said grooves are spaced to miss said cutting rule so that said cutting rule does not extend through said grooves.

12. The rotary cutting die apparatus of claim 11, wherein said transverse groove is disposed over said valves.

13. The rotary cutting die apparatus of claim 12, wherein said valves are disposed in recesses in a bar embedded in said die mounting surface and extending thereacross in said direction, holes in said cylinder connect said recesses to said cylinder interior, and a transverse peripheral edge of said cutting die overlies said bar.

14. Rotary printing die apparatus, comprising:

a printing cylinder having a die mounting surface and being mounted between spaced apart supports for rotation about a central axis;

means for connecting an interior of said cylinder to a source of subatmospheric pressure;

a plurality of circumferential grooves in said surface and extending around said axis, said grooves being spaced apart transversely across said cylinder in a direction parallel to said axis;

an elongate bar disposed in said surface and extending lengthwise across said cylinder parallel to said axis, said bar extending across said grooves;

a plurality of valves carried by said cylinder and controlling application of said subatmospheric pressure from said cylinder interior to said grooves;

said valves being spaced apart transversely across said cylinder at the location of said bar and communicating with said grooves to one side of said bar;

said valves having depressible actuating members which protrude proud of said surface when the valves are closed, any one of said valves being selectively opened by depression of its respective actuating member;

a printing die removably mounted on said cylinder with a leading transverse edge of said die juxtaposed said bar, said die being held on said surface by the subatmospheric pressure applied to those of the grooves which are covered by said die consequential upon depression by said die of the actuating members of those of the valves covered by said die; and a strip of flexible and readily deformable material secured to said die and extending from and across a trailing transverse edge of said die, said strip being deformed by the subatmospheric pressure into the grooves covered by said trailing transverse edge to close and seal these covered grooves at said trailing transverse edge, these covered grooves being sealed at said leading transverse edge of said die by said bar.

15. The rotary printing die apparatus of claim 14, wherein said valves are disposed in recesses in said bar.

16. The rotary printing die apparatus of claim 15, wherein said actuating members comprise ends of pivoted valve members.

17. The rotary printing die apparatus of claim 14, wherein said valves are disposed in recesses extending below said surface, said recesses being in communication with said grooves and said recesses being connected to said cylinder interior by holes in said cylinder.

18. The rotary printing die apparatus of claim 17, wherein said recesses are wider in said direction than said grooves.

19. The rotary printing die apparatus of claim 14, wherein said material of said strip comprises magnetic material and said die mounting surface is ferrous.

20. The rotary printing die apparatus of claim 14, wherein said grooves are rounded in cross-section to enable said strip of flexible material to more readily conform to the shape of said grooves.

* * * * *